US007755487B2

(12) United States Patent
O'Hagan

(10) Patent No.: US 7,755,487 B2
(45) Date of Patent: Jul. 13, 2010

(54) INTERFACE FOR COMMUNICATING WITH AN INFORMATION PROCESSING DEVICE

(75) Inventor: James O'Hagan, McHenry, IL (US)

(73) Assignee: ZIH Corp., Hamilton (BM)

( * ) Notice: Subject to any disclaimer, the term of this patent is extended or adjusted under 35 U.S.C. 154(b) by 691 days.

(21) Appl. No.: 11/682,584

(22) Filed: Mar. 6, 2007

(65) Prior Publication Data

US 2007/0229224 A1 Oct. 4, 2007

Related U.S. Application Data

(60) Provisional application No. 60/779,744, filed on Mar. 7, 2006.

(51) Int. Cl.
*G08B 13/14* (2006.01)

(52) U.S. Cl. ..... 340/572.1; 340/572.7; 340/572.8; 340/539.1; 340/10.1; 235/375

(58) Field of Classification Search ..... 340/572.1, 340/572.7, 572.8, 539.1, 10.1; 235/375, 235/376, 487, 492

See application file for complete search history.

(56) References Cited

U.S. PATENT DOCUMENTS 5,629,981 A * 5/1997 Nerlikar ..... 713/168
6,751,732 B2 6/2004 Strobel et al.
7,310,162 B2 * 12/2007 Morris-Jones ..... 358/1.15
2003/0044216 A1 * 3/2003 Fang ..... 400/491
2003/0132094 A1 * 7/2003 Mickle et al. ..... 200/539

OTHER PUBLICATIONS

Clive Hohberger, "Data Acquisition System and RFID Reader-Printer," Ip.com Technical Disclosure IPCOM000031096D, <http://www.ip.com/pubview/IPCOM000031096D>, Sep. 10, 2004.

* cited by examiner

*Primary Examiner*—Hung T. Nguyen
(74) *Attorney, Agent, or Firm*—Alston & Bird LLP

(57) ABSTRACT

The present invention provides a membrane assembly that integrates an antenna configured to communicate with an RFID device to receive and/or write RFID data to and/or from the RFID device. In various embodiments, the membrane assembly may be incorporated into an information processing device, and the information processing device may be included in an information system. The membrane assembly includes at least a first antenna adapted to wirelessly communicate with an RFID device that may be associated with (i.e. worn, held, attached to, or otherwise related to) a user. The wireless communication between the membrane assembly and the RFID device provides the basis for controlling the information processing device. In various embodiments, the RFID data may be used to authorize, customize, and/or otherwise affect the performance of the information processing device.

24 Claims, 10 Drawing Sheets

INTERFACE FOR COMMUNICATING WITH AN INFORMATION PROCESSING DEVICE

CROSS-REFERENCE TO RELATED APPLICATIONS

This application claims priority from U.S. Provisional Application No. 60/779,744, filed Mar. 7, 2006, which is hereby incorporated herein in its entirety by reference.

BACKGROUND OF THE INVENTION

1. Field of the Invention

The present invention is directed generally to information technology and more particularly to a system, apparatus, and method for communicating with an information processing device.

2. Description of the Related Art

There are many ways for a user to interface with an information processing devices such as printers, copiers, facsimile machines, PDAs, home appliances, medical devices, etc. Typically, users interact with such devices via buttons, switches, lights, displays, keyboards, microphones, scroll wheels, knobs, joysticks, etc. Membrane assemblies provide another user interface for information processing devices. Some membrane assemblies may include membrane switch assemblies. Existing membrane assembly technology allows some of these interfaces (e.g. a button and a light) to be combined into a single part. A typical membrane assembly may include a top, graphical layer, which can be seen by the user, a second, functional layer, incorporating various electronic components, and electrical connections that facilitate power and information sharing between the membrane switch and the rest of the information processing device.

There are many benefits urging incorporation of a membrane assembly into the design of an information processing device. For example, because a membrane assembly can encompass a large number of user interfaces into a single device, a membrane assembly may be used as a control subsystem, simplifying the information processing device design process. Because membrane assemblies are modular, multiple components can be combined into a single subassembly, often saving material, tooling, and assembly costs. And because membrane assemblies are substantially sealed to the outside world, they are extremely reliable while remaining easy to assemble and/or service.

Information processing devices, such as those used in domestic, industrial, and commercial settings, are becoming increasingly complex. With this complexity comes the ability to authorize, customize, and/or otherwise affect the performance of an information processing device based on data supplied by a user. RFID technology provides efficient, instantaneous communication of data between a reader and an RFID transponder without requiring unobstructed directed near field communication as is commonly needed in more conventional automatic identification technologies (e.g., barcode, optical scanning, etc.). The use of Electronic Article Surveillance, Radio Frequency Identification, and electronic security tag technology (hereinafter collectively referred to as 'RFID') is becoming increasingly prevalent in business, manufacturing, retail, and residential settings.

RFID technology involves the transmission of information through electromagnetic waves. A typical RFID system includes an RFID transponder and an RFID reader. The RFID transponder includes a circuit chip and an antenna attached to the circuit chip. The circuit chip and antenna are generally thin, flexible, and mounted to a flexible dielectric substrate.

Antennas have numerous configurations and each is structured generally to broadcast and receive electromagnetic energy. RFID transponders can be programmed to store a variety of data. For example, RFID transponders often are programmed to store retail product information such as a product serial number, manufacturer identification information, product type, price, or other like information. RFID transponders may also include identifying or verifying information, for example an RFID transponder may contain information suggesting the identity of an article or the identity of a person carrying the article.

Information processing devices may be designed to use RFID data to authorize, customize, and/or otherwise affect the performance of the information processing device based on the supplied RFID data. Such RFID data can be helpful in providing secure media output. It is typical in a business or manufacturing setting to link a common media output device to a network. Many users, or groups of users, may be given access to a specific device. The media output generated by the different users may become intermixed. Unlike some settings, where a glance at the content of the media output may give an indication as to which user is the intended user, in some manufacturing settings, the media output is more difficult to decipher. If, for example, a first package shipping employee and a second package shipping employee are sending label information to a single barcode label printer for the purpose of printing out labels to be placed on shipped packages, different barcode labels may appear very similar. If the first employee sends her information to the network label printer before the second employee sends his information, the first employee's label will be the first media output produced, even if the second employee reaches the label printer before the first employee. Unable to decipher the media output, the second user is likely to believe that the label is intended for him and will use the incorrect label. Although one solution typically implemented with regard to business printer networks involves the use of a "header sheet" that precedes each user's printer output. In high traffic areas such header sheets may be displaced leaving confidential information exposed. A header sheet that indicates the intended recipient could stimulate interest or draw attention to the information. Also, the use of header sheets wastes time as well as paper, and often the sheets are misplaced or discarded by other users.

There is a need for a system, apparatus and method for wirelessly providing RFID data to an information processing device to authorize, customize, and/or otherwise affect the performance of the information processing device. The system, apparatus, and method should be appropriate for use with a variety of information processing devices, and should be simple and inexpensive to operate.

BRIEF DESCRIPTION OF THE DRAWINGS

The objects and advantages of the present invention will become more readily apparent to those of ordinary skill in the relevant art after reviewing the following detailed description and accompanying drawings, wherein.

DETAILED DESCRIPTION OF THE INVENTION

Figure 1:
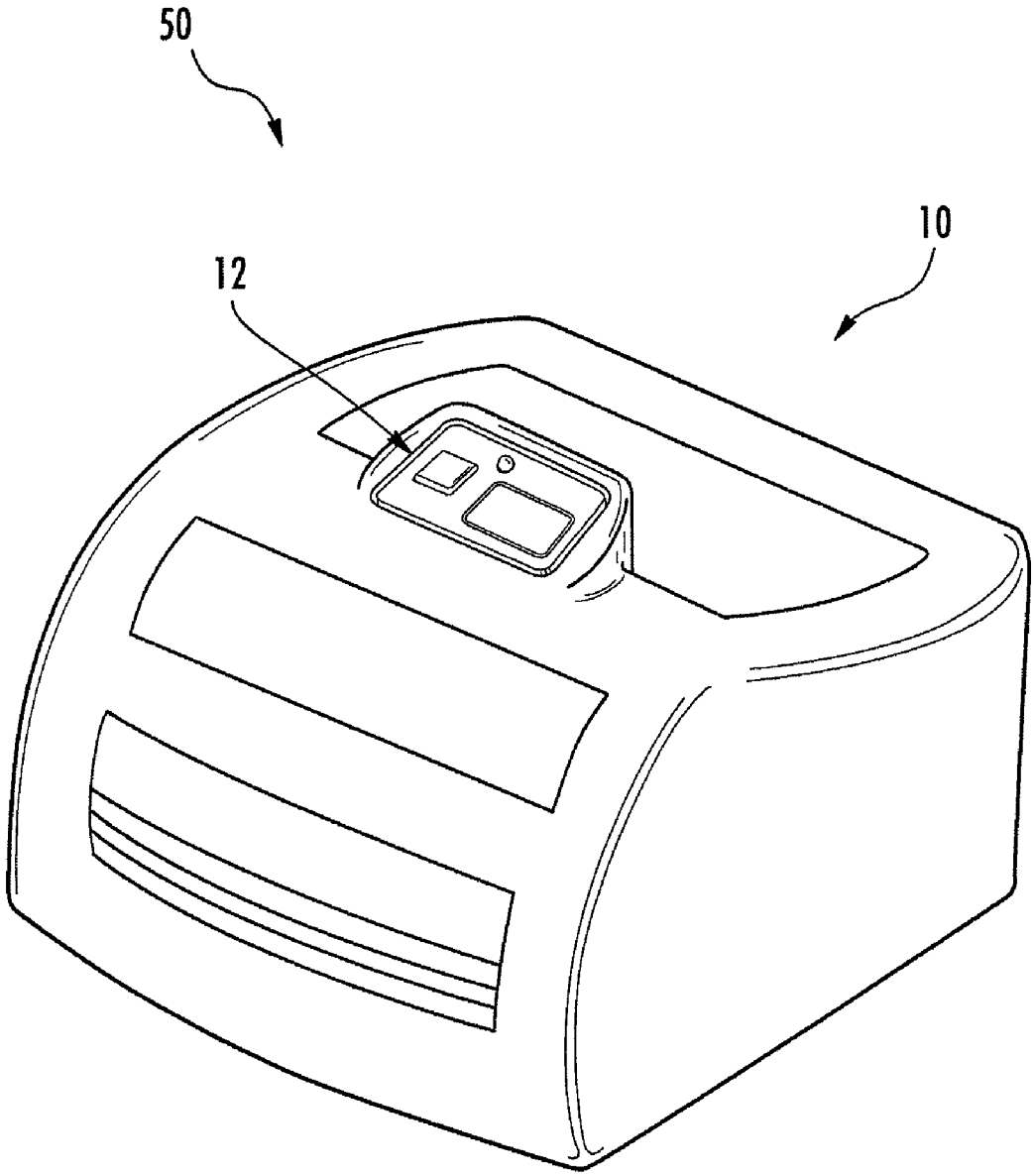
FIG. 1 is a perspective view of an information system for providing secure, on-demand media output in accordance with one embodiment of the present invention.

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

The present invention addresses the above needs and achieves other advantages by providing a membrane assembly that integrates an antenna configured to communicate with an RFID device to receive and/or write RFID data to and/or from the RFID device. In various embodiments, the membrane assembly may be incorporated into an information processing device. In one embodiment, the membrane assembly includes a first antenna adapted to wirelessly communicate with an RFID device that may be associated with (i.e. worn, held, attached to, or otherwise related to) a user. As will be described in detail below, the wireless communication between the membrane assembly and the RFID device may facilitate a user's operation of the information processing device.

Incorporating one or more antennas within a membrane assembly provides many advantages over the prior art. For example, it provides the benefits of RFID communication without the drawbacks of redesigning the information processing device. Membrane assemblies are generally located outside the metal enclosure or housing that is used to protect most information processing devices. This location prevents undue shielding of the antenna from interrogating RFID devices located outside the information processing device. Such an antenna position provides better read/write capabilities at reduced power levels. This antenna location also allows the antenna to be relatively isolated from the electronic noise of the information processing device electronics. A membrane assembly is modular, thus providing a separate subsystem. RFID capabilities may be added to existing information processing devices by adding a membrane assembly of the present invention or by modifying an existing membrane assembly consistent with the present invention. Many membrane assemblies include a layer for electronics, thus an antenna may be added for minimal (sometimes zero) incremental cost. Many membrane assemblies are sealed, thus protecting the antenna(s) from harm. Also, because a top layer of the membrane assembly may be easily customized, the addition of the RFID antenna can be promoted or hidden from users as the designer allows.

Incorporating an antenna capable of communicating with an RFID device into a membrane assembly provides further benefits for new designs, due largely to the modular character of the membrane assembly. RFID is an emerging technology, and improved devices, systems, and antenna designs are appearing at a rapid pace. Incorporating antenna(s) into the membrane assembly allows a current information processing device to be designed and released, and provides a clear upgrade path as new technology becomes available. New antenna designs can be developed over time as technology progresses and new customer applications appear. These designs can then be tested and released as part of a newly designed membrane assembly upgrade. The upgrade can be rolled into existing manufacturing processes with minimal changes to assembly procedures. The upgrade may also be performed in the field with the same ease of replacing a damaged membrane assembly today: unplug the old assembly, peel it off the equipment, clean off any adhesive residue, stick on the new assembly, plug it in and reassemble, load new firmware and test. The result is rapid adaptation to the latest technologies with minimal upgrade cost.

For the purposes of the current specification and appended claims, the term "information processing device" refers to a broad collection of devices that are capable of receiving, transmitting, and/or otherwise processing electronic information. For example, specific exemplary information processing devices include, but are not limited to, media output devices, such as printers, copiers, facsimile machines, etc., computing devices, such as computer terminals, PDAs, etc., consumer electronic devices, such as blood pressure machines, video arcade controllers, home appliances, etc., and commercial electronic devices, such as bar code readers, factory equipment, medical devices, etc.

The term "RFID data" refers to any type, form, or subject matter of information and/or data that can be used by an information processing device to authorize, customize, and/or otherwise affect the performance of the information processing device. RFID data may also be any type, form, or subject matter of information that originates in the information processing device. For example, RFID data may include, but is not limited to, a product serial number, manufacturing information, a user's security code, employee number, or social security number, information used to control a consumer product, and calibration information used to calibrate commercial electronic devices.

The term "RFID device" refers to any device that includes a memory or identity and a mechanism for communicating wirelessly with the membrane assembly such as remotely detectable tags that incorporate RFID or other similar technologies. The tags may be active or passive. For example, RFID devices may include identification tags, badges, wristbands, labels, smart cards, optical communication tags, capacitive tags, Electronic Article Surveillance tags, and the like.

The current specification and appended Figures describe a specific information processing device, namely, a printer, and a specific RFID device, namely, an RFID wristband, for illustration purposes. Other embodiments of the present invention may be used to communicate any type of RFID data to be received, transmitted, and/or otherwise processed by any type of information processing device. Thus, in one exemplary embodiment, an RFID device may report the identity of an article or the identity of a person or animal associated with the article. In other embodiments, the RFID device may report RFID data that may be used to customize and/or otherwise affect the performance of the information processing device. In still other embodiments, RFID devices may also receive RFID data from an information processing device, thereby allowing it to carry information away from the information processing device, often to be communicated to another information processing device, or back to that same information processing device, at a later time. As a result, the specific exemplary description provided herein should not be construed as limiting.

Figure 2:
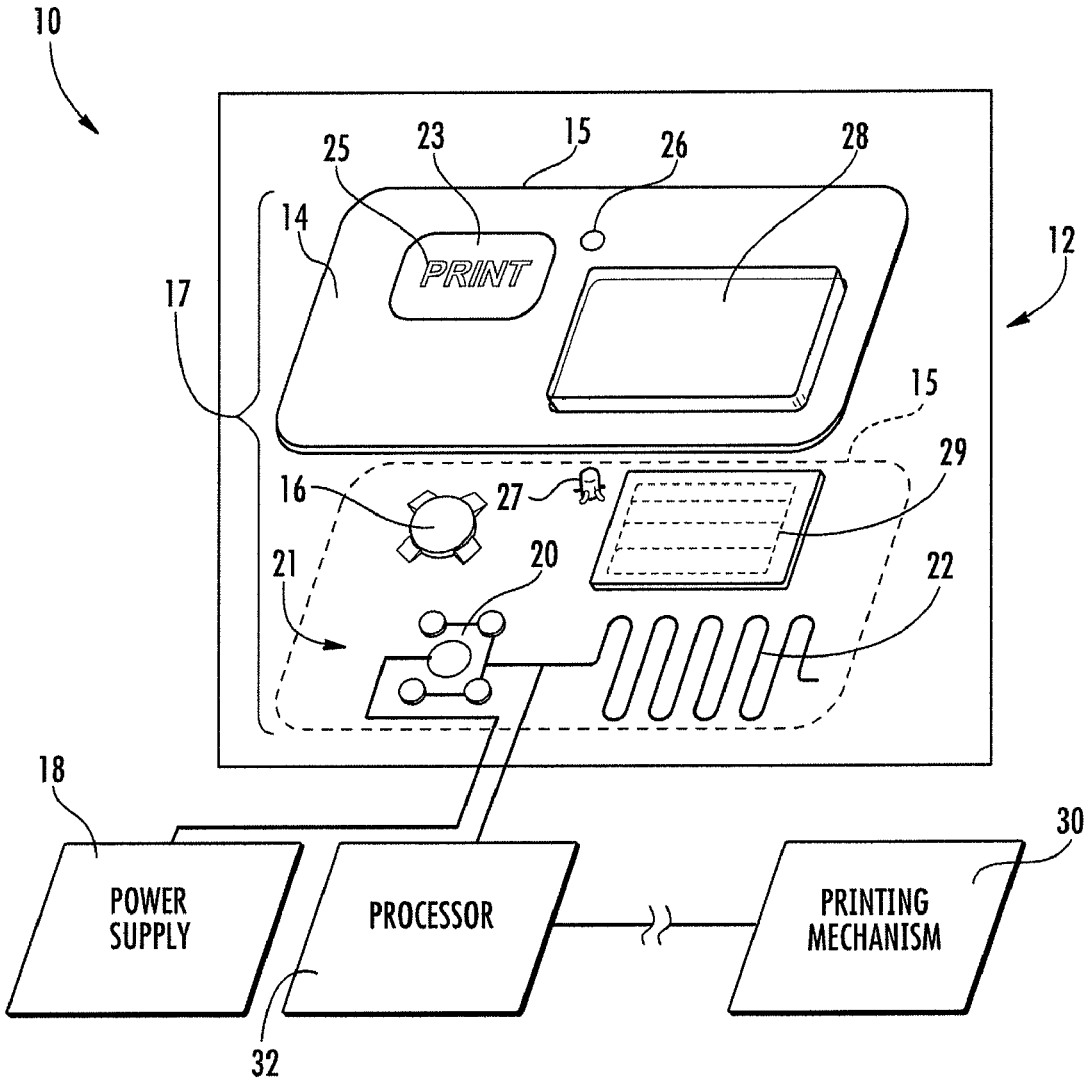
FIG. 2 is a detail view of a membrane assembly shown in schematic relation to other components of the information system depicted in FIG. 1.
Figure 3:
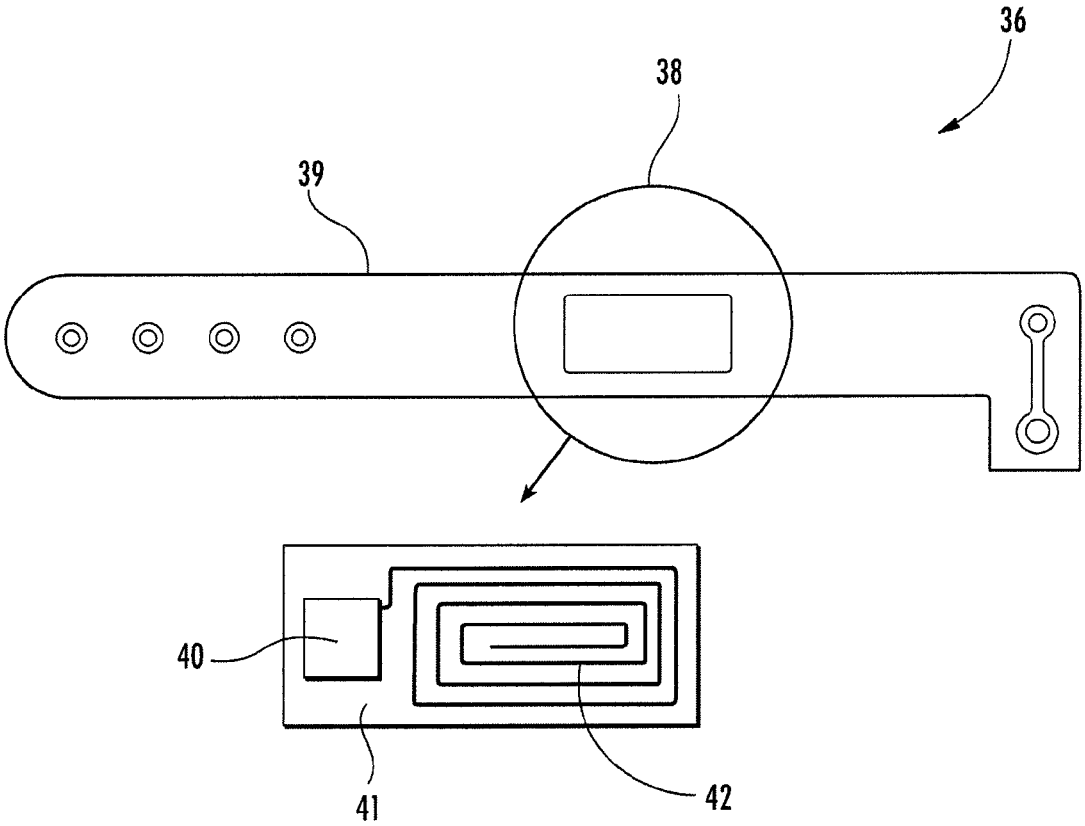
FIG. 3 is a top view of an exemplary RFID device used in conjunction with the information system depicted in FIG. 1.

FIGS. 1-4 depict one embodiment of the present invention showing an information system 50 having a membrane assembly 12 used to provide information to an information processing device 10. In the depicted embodiment, the processing device 10 is represented by a network label printer, which provides secure, on-demand media output, in the form of printed barcode labels 11. The information processing device 10 includes the membrane assembly 12. Referring to FIG. 2, the membrane assembly 12 includes a first antenna 22 and a membrane layer 14 that defines a membrane perimeter 15. The membrane layer 14 has a surface adapted to be pressed by a user 43. At least a portion of the first antenna 22 is proximate the membrane layer 14 within the membrane perimeter 15 when viewed from a perspective substantially perpendicular to the membrane layer 14. In the depicted embodiment, a switch assembly 17 is included that comprises a button area 23, a tactile member 16, and a bottom circuit 21. It should be noted, however, that in other embodiments, the membrane assembly 12 need not include a switch assembly 17. The depicted first antenna 22 is a single layer antenna disposed in a serpentine pattern, however, in alternate embodiments, other antenna structures may be used including multi-layered antennas and antennas of any shape. The first antenna 22 may be constructed by any method known in the art, including printing, etching, or deposition processes.

In the depicted embodiment, the membrane layer 14 is made of a flexible and durable material such as polyester however many other materials may be used including, but not limited to, polycarbonate and various other elastomers. The membrane layer 14 may also include various graphics. For example, the button area 23 may include indicia 25 intended to instruct the user regarding use of the information system 50. In various embodiments, the membrane layer 14 may also have other user interface components such as an LED indicator light 27 visible through an LED window 26 in the membrane layer 14 and an indication display 29 visible through a display window 28 in the membrane layer 14. The LED indicator light 27 and the indication display 29 may provide a variety of feedback information to a user such as the status of the information processing device 10 and whether successful communication has been established. In various other embodiments, the LED indicator light 27 and/or the indication display 29 may serve as non-printed media output.

In the depicted embodiment, activation of the membrane assembly 12 transmits a read pulse from the first antenna 22. The membrane layer 14 is supported by a tactile member 16 that is configured to align with the button area 23 of the membrane layer 14. The tactile member 16 is also configured to align with an activator 20 that is part of a bottom circuit 21. In the depicted embodiment, the tactile member 16 is an electrically conductive metal cone, such as a stainless steel cone, but in other embodiments the tactile member 16 may comprise any design and/or material sufficient to activate the bottom circuit 21 and to provide the desired tactile feedback. It should be noted that, in other embodiments, the membrane assembly 12 may comprise additional top circuits, adhesive layers, spacer layers, and/or other similar structures known in the art.

In the depicted embodiment, the bottom circuit 21 is connected to a power supply 18. The power supply 18 comprises an energy releasing device that, when activated, provides sufficient energy to power the membrane assembly 12 such that the first antenna transmits an appropriate read pulse. The read pulse is adapted to communicate with an RFID device 36, which is shown by example in FIG. 3 as an RFID wristband. The RFID device 36 includes an RFID transponder 38 attached to an elongated strip of material designed to be wrapped around a user's wrist. In the depicted embodiment, the RFID transponder 38 is passive and includes a circuit chip 40 and antenna 42 mounted on a substrate 41.

Referring back to FIG. 2, in the depicted embodiment, the first antenna 22 is configured as both a signal generator, in which the first antenna 22 transmits a read pulse to the RFID device 36, and a signal receiver, in which the first antenna receives the information transmitted by the RFID device 36 in response to the read pulse sent by the first antenna 22. A processor 32 is connected to the bottom circuit 21 so that the information received by the first antenna 22 may be processed into instructions for a printing mechanism 30. In the depicted embodiment, the printing mechanism 30 is a thermal printing mechanism that includes a thermal printhead adapted to print barcode information onto label media.

Figure 4:
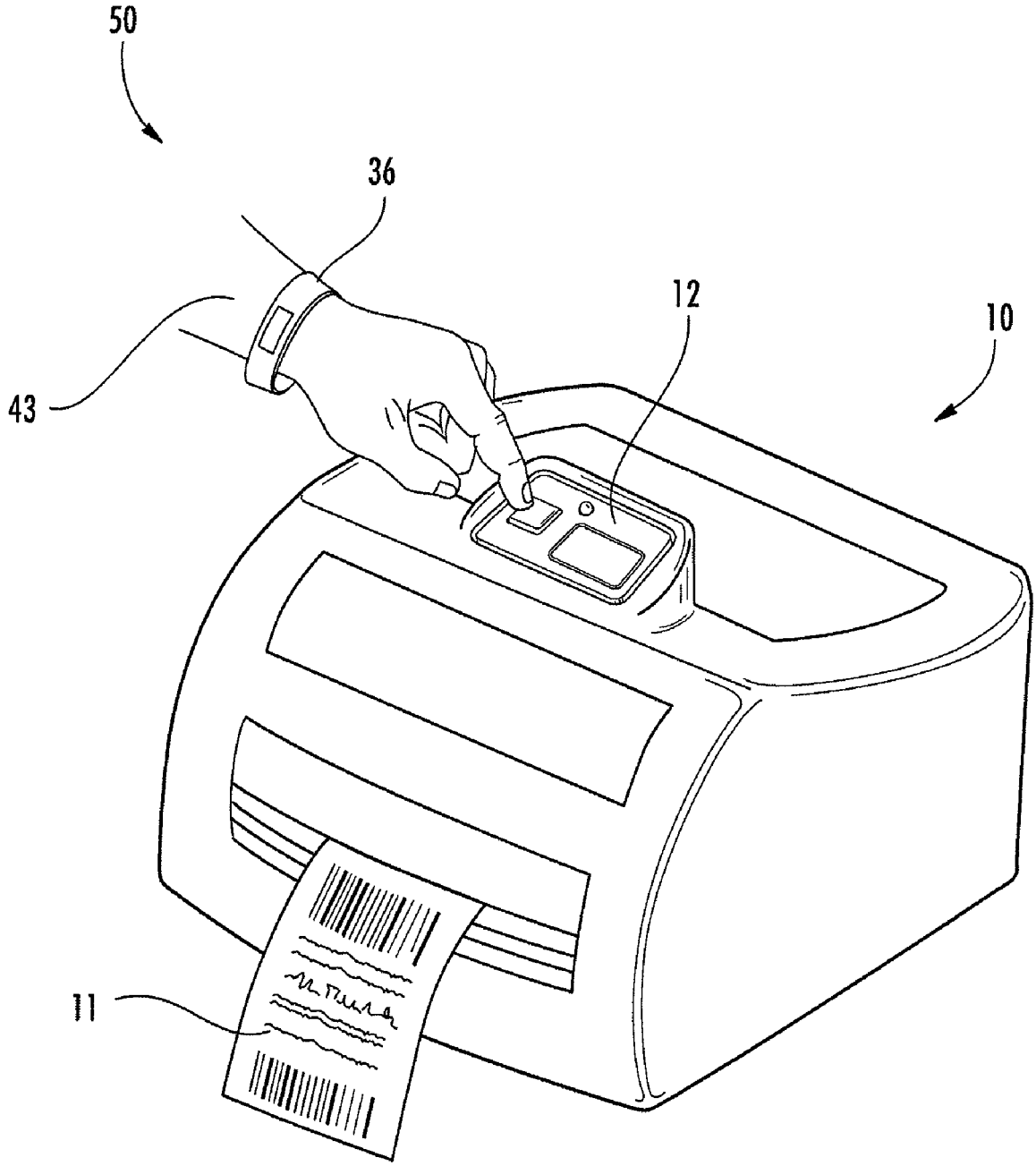
FIG. 4 is perspective view of an information system in accordance with one embodiment of the present invention.

FIG. 4 shows the user 43, with an RFID device 36, activating the membrane assembly 12 in order to gain authorized access to the information processing device 10. In the depicted embodiment, upon pressing the button area 23 of the switch assembly 17, the tactile member 16 contacts the activator 20 of the bottom circuit 21 thereby activating the membrane assembly 12. Once the switch assembly 17 is activated, power from the power supply 18 energizes the first antenna 22 such that a read pulse is transmitted from the first antenna 22. The read pulse then energizes the RFID transponder 38 attached to the RFID device 36, which is attached to a wrist of the user 43. As noted above, although the depicted embodiment shows an RFID device 36 in the form of a wristband, the read pulse may energize any type of RFID device 36, such an identification tag, badge, label, smart card, etc. It should also be noted that in other embodiments, including those that do not include a switch assembly 17, the antenna 22 may be continuously powered and thus the membrane assembly 12 need not include a button area 23. In such embodiments, the RFID device 36 is read when it is passed over an area of the membrane assembly 12 proximate the area in which the antenna 22 is located. For a passive RFID device, this area may be relatively close to the antenna 22, in some instances approximately 1" to 6" from the antenna 22, however for an active RFID device, this area may extend much further from the antenna 22. Such embodiments are particularly advantageous where RFID data communicated to an information processing device is used to customize or otherwise affect the performance of the information processing device. These embodiments are also advantageous where the information processing device transmits information to an RFID device.

Referring back to the embodiment depicted in FIG. 4, the RFID transponder 38 responds to the read pulse by transmitting RFID data stored by the RFID transponder 38. The first antenna 22 is configured to receive this RFID data. Once received by the first antenna 22, the processor 32 then converts the RFID data into instructions that control access to the information processing device 10. In the depicted embodiment, the processor 32 compares the RFID data to a list of secure labels waiting in a printing queue. If the RFID data provided by the RFID device 36 matches information available in the printing queue, the processor 32 controls the printing mechanism 30 to print the information, thus providing secure, on-demand media output for the user 43. It should be noted that in the other embodiments, the processor 32 may use the RFID data in various other ways. For example, the processor 32 could compare the received RFID data against a list of identities corresponding to users who are authorized to use the information apparatus 10.

Alternatively, the processor 32 could compare the RFID data against a bank of information intended for the particular user associated with the RFID data. In embodiments in which the information processing device provides electronic information, rather than printed information, the processor 32 could compare the RFID data against electronic messages intended for a user associated with that RFID data, such that the processor 32 controls the information processing device 10 to display the appropriate media output for the user. Also, the processor 32 may merely compile data regarding the users who gained access to the information processing device 10.

In other embodiments, the present invention may be used to gather and compile information from an RFID device, such as to track the identities and access times of various users who gained access to a particular information processing device. In other advantageous embodiments, the RFID data may be used to customize and/or otherwise affect the performance of the information processing device 10.

Figure 5:
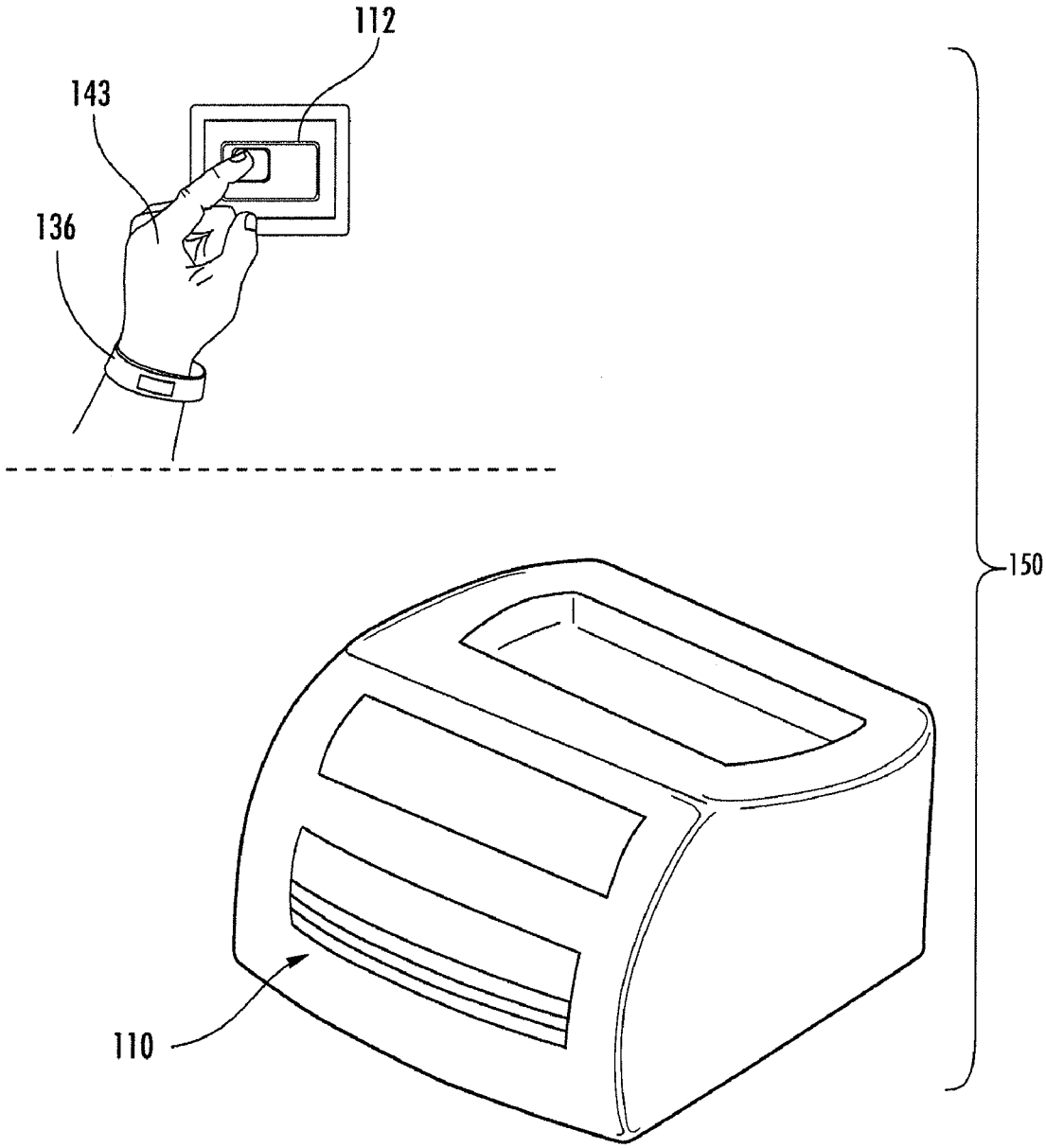
FIG. 5 is a perspective view of an information system in accordance with another embodiment of the present invention.
Figure 6:
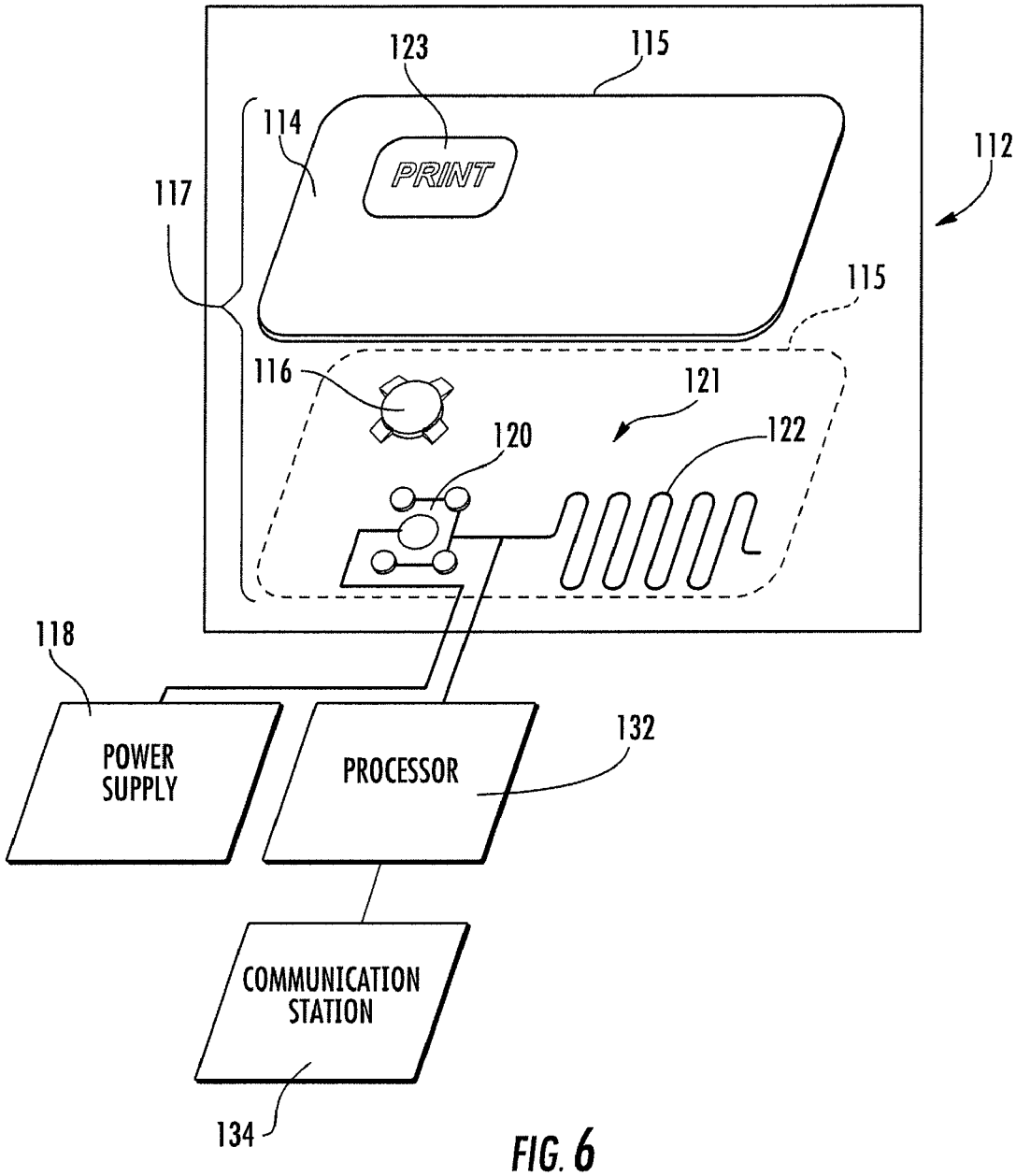
FIG. 6 is a detail view of a membrane assembly shown in schematic relation to other components of an information system in accordance with the embodiment of the embodiment depicted in FIG. 5.

FIGS. 5 and 6 depict another embodiment of the present invention that shows an information system 150 having a membrane assembly 112 that incorporates a communication station 134 for controlling access to a remote information processing device 110. As similarly described above, in the depicted embodiment, the membrane assembly 112 includes a first antenna 122 and a membrane layer 114 that defines a membrane perimeter 115. The membrane layer 114 has a surface adapted to be pressed by a user 143. At least a portion of the first antenna 122 is located proximate the membrane layer 114 within the membrane perimeter 115 when viewed from a perspective substantially perpendicular to the membrane layer 114. In the depicted embodiment, a switch assembly 117 is included that comprises a button area 123, a tactile member 116, and a bottom circuit 121. It should be noted, however, that in other embodiments, the membrane assembly 112 need not include a switch assembly 117.

In the depicted embodiment, a processor 132 is connected to the bottom circuit 121. In this embodiment, the processor 132 is also connected to a communication station 134 capable of communicating with a remote information processing device 110, shown by example in FIG. 5 as a remote thermal barcode printer. In the depicted embodiment, the communication station 134 communicates wirelessly with the information processing device 110, however, the communication station 134 my communicate using any communication method as is commonly known in the art, such as through wired, wireless, and infra-red connections. As shown in FIG. 5, when a user 143 carrying an RFID device 136 activates the membrane assembly 112, the first antenna is energized by a power supply 118 so that it transmits a read pulse to the RFID device 136. The first antenna 122 receives the RFID data transmitted by the RFID device 136 and the RFID data is processed by the processor 132. The processor 132 then processes the RFID data into instructions that are communicated to the communication station 134. The communication station 134 then communicates with the remote information device 110 as shown in FIG. 5, to provide secure, on-demand media output. This embodiment may be advantageous in situations where the RFID data provided by the RFID device 136 may be used for other purposes, such as for controlling entry into a secured location, in addition to providing controlled access to the information processing device 110.

Figure 7:
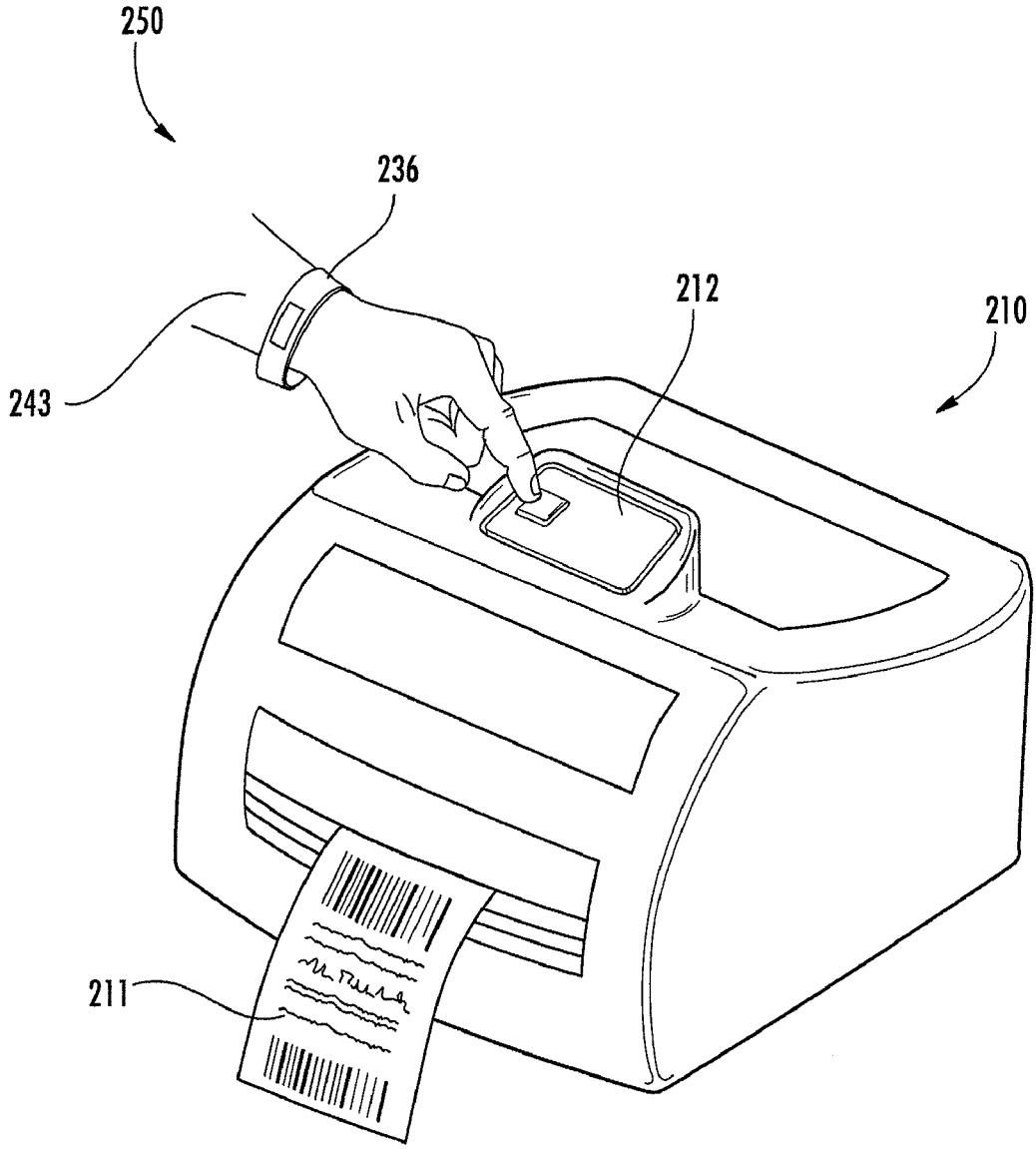
FIG. 7 is perspective view of an information system in accordance with another embodiment of the present invention.
Figure 8:
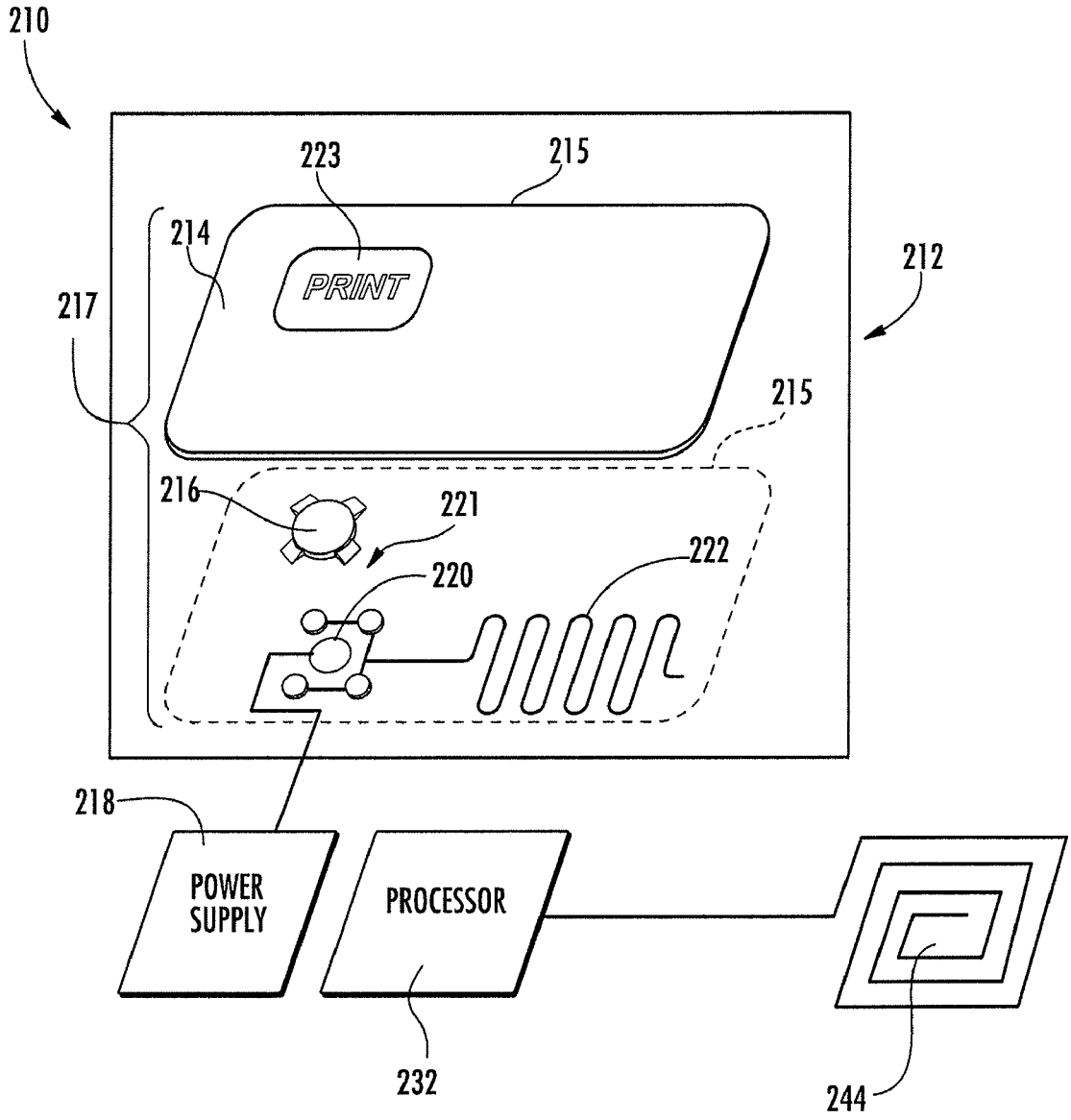
FIG. 8 is an detail view of a membrane assembly shown in schematic relation to other components of the information system depicted in FIG. 7.

It should be noted that other embodiments of the present invention may include additional antennas that also communicate with an RFID device. For example, FIGS. 7 and 8 show an embodiment of the present invention that depicts an information system 250 incorporating a second antenna 244 for receiving the RFID data transmitted by an RFID device (not shown) in response to a read pulse transmitted by a first antenna 222. As similarly described with respect to the embodiments shown in FIGS. 1-6 above, the depicted embodiment includes a membrane assembly 212 having a first antenna 222 and a membrane layer 214 that defines a membrane perimeter 215. At least a portion of the first antenna 222 is proximate the membrane layer 214 within the membrane perimeter 215 when viewed from a perspective substantially perpendicular to the membrane layer 214. In the depicted embodiment, a switch assembly 217 is included that comprises a button area 223, a tactile member 216, and a bottom circuit 221. A processor 232 is connected to the bottom circuit 221. When a user carrying an RFID device activates the membrane assembly 212, the first antenna 222 is energized by a power supply 218 so that the first antenna 222 transmits a read pulse to the RFID device. In the depicted embodiment, a second antenna 244 receives the RFID data transmitted by the RFID device. The second antenna is connected to a processor 232 that processes the RFID data into instructions that are communicated to a printing mechanism 230. The second antenna 244 is shown as a single layer antenna disposed in a spiral pattern, however, in alternate embodiments, other antenna structures may be used including multi-layered antennas and antennas of any shape. As noted above, the first antenna 222 and the second antenna 244 may be constructed by any method known in the art including printing, etching, or deposition processes. Also, although the depicted embodiment shows the second antenna 244 outside the membrane assembly 212, in other embodiments, at least a portion, or alternatively all, of the second antenna 244 may be located within the membrane perimeter 215.

Figure 9:
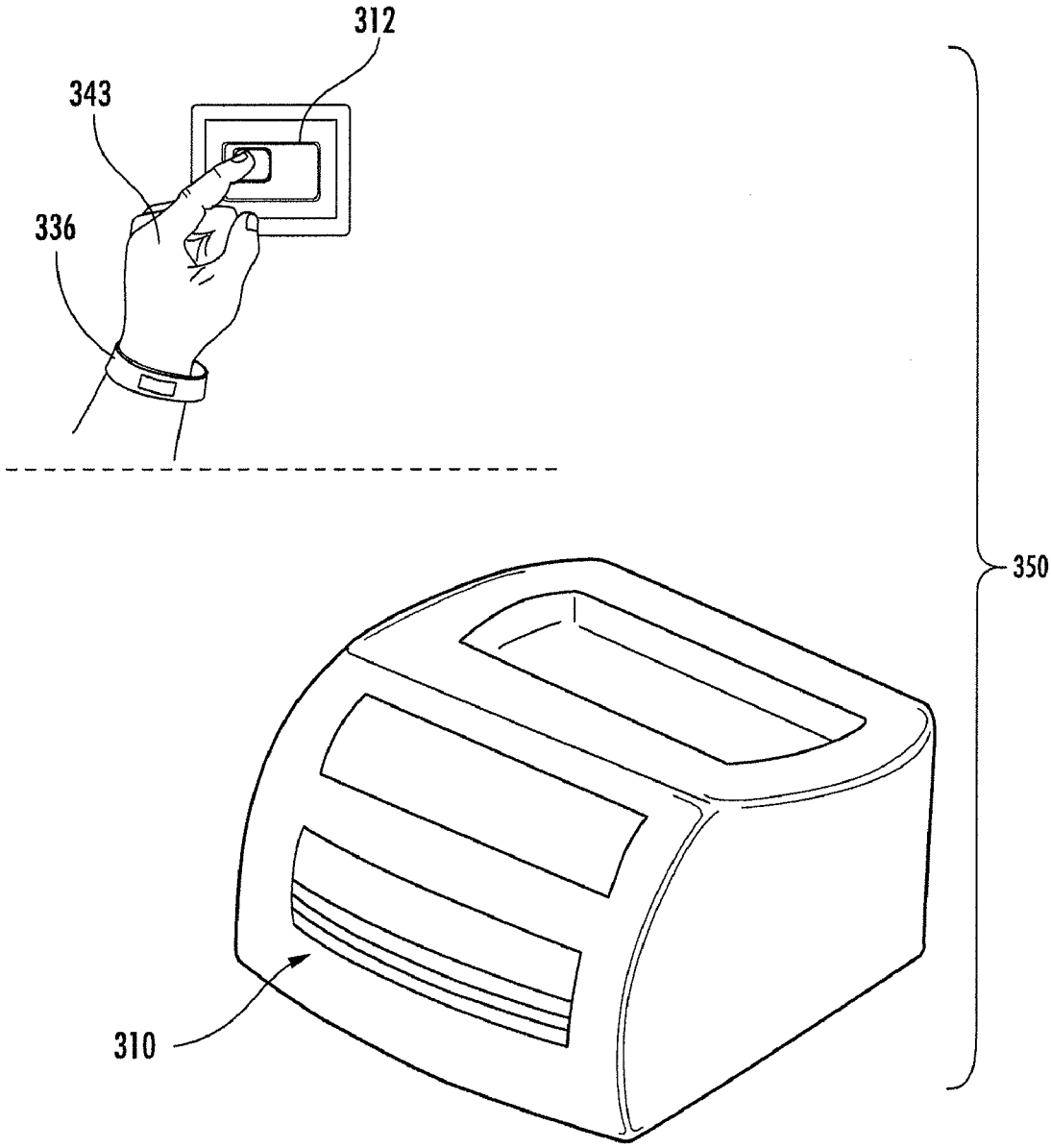
FIG. 9 is a perspective view of an information system in accordance with another embodiment of the present invention.
Figure 10:
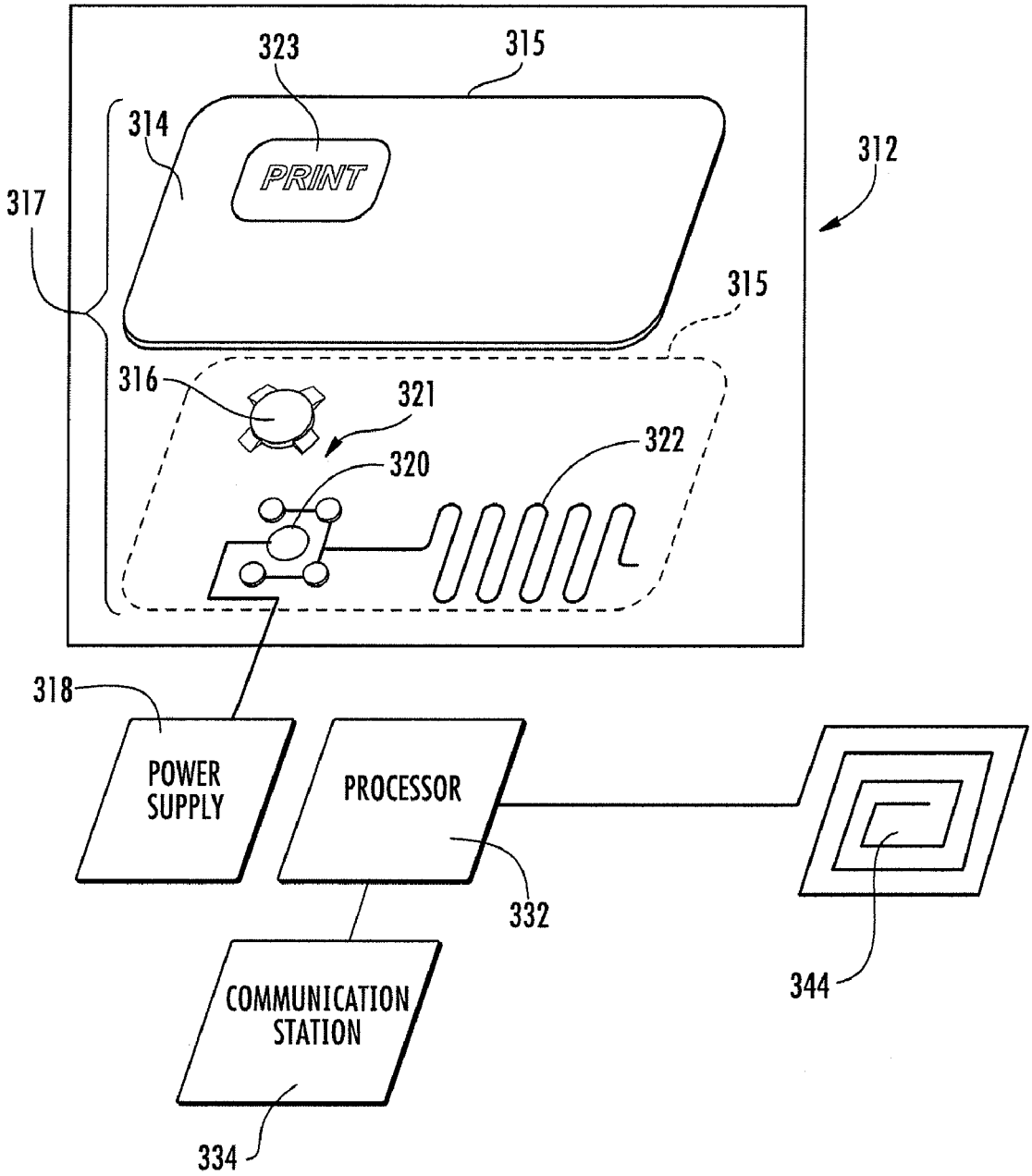
FIG. 10 is a detail view of a membrane assembly shown in schematic relation to other components of the information system depicted in FIG. 9.

FIGS. 9 and 10 depict still another embodiment of the present invention showing an information system 350 incorporating both a second antenna 344 and a communication station 334 for communicating instructions from a processor 332 to a remote information processing device 310. As similarly described with respect to the embodiments depicted in FIGS. 1-8 above, the depicted embodiment includes a membrane assembly 312 that includes a first antenna 322 and a membrane layer 314 that defines a membrane perimeter 315. The membrane layer 314 has a surface adapted to be pressed by a user 343. At least a portion of the first antenna 322 is proximate the membrane layer 314 within the membrane perimeter 315 when viewed from a perspective substantially perpendicular to the membrane layer 314. In the depicted embodiment, a switch assembly 317 is included that comprises a button area 323, a tactile member 316, and a bottom circuit 321. It should be noted, however, that in other embodiments, the membrane assembly 312 need not include a switch assembly 317. A processor 332 is connected to the bottom circuit 321. In the depicted embodiment, the processor 332 is also connected to a communication station 334 capable of communicating with a remote information processing device 310, shown by example in FIG. 9 as a remote barcode label printer. In the depicted embodiment, the communication station 334 communicates wirelessly with the information processing device 310, however, the communication station 334 may communicate using any communication method as is commonly known in the art, such as through wired, wireless, and infra-red connections. When a user carrying the RFID device activates the membrane assembly 312, the first antenna 322 is energized by a power supply 318 so that the first antenna 322 transmits a read pulse to the RFID device 336. In the depicted embodiment, a second antenna 344 receives the RFID data transmitted by the RFID device. The second antenna is connected to the processor 332 that processes the RFID data into instructions that are communicated to the communication station 334 that in turn provides controlled access to the remote information processing device 310.

As noted above, although the above embodiments of the present invention relate to membrane switch assemblies, systems, and methods that communicate RFID data that is used by an information processing device for authorization, such as to provide secure media output, other embodiments of the present invention relate to membrane switch assemblies, systems, and methods that communicate RFID data that is used by an information processing device to customize and/or otherwise affect the performance of the information processing device, as well as to write RFID data from an information processing device to an RFID device.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An information processing device adapted for wirelessly communicating with an RFID device associated with a user, said information processing device comprising:

a membrane assembly comprising:

a membrane layer having a surface adapted to be pressed by the user, said membrane layer defining a membrane perimeter; and a first antenna adapted to wirelessly communicate with the RFID device, wherein at least a portion of said antenna is disposed proximate said membrane layer within said membrane perimeter.

2. The information processing device of claim 1, wherein said antenna transmits a radio frequency read pulse to the RFID device.

3. The information processing device of claim 2, wherein said antenna is capable of receiving RFID data transmitted by the RFID device in response to said read pulse.

4. The information processing device of claim 1, wherein said membrane layer includes a switch assembly having a button area, and wherein said switch assembly is adapted to complete a bottom circuit for activating said antenna when said button area is depressed by the user.

5. The information processing device of claim 3, further comprising a processor in communication with said antenna for processing said RFID data received by said first antenna.

6. The information processing device of claim 5, wherein said processor processes said RFID data to authorize, customize, and/or otherwise affect the performance of said information processing device.

7. The information processing device of claim 1, further comprising a second antenna, wherein said first antenna transmits a read pulse to the RFID device and said second antenna is capable of receiving RFID data transmitted by the RFID device in response to said read pulse.

8. The information processing device of claim 1, further comprising a processor in communication with said second antenna for processing said RFID data received by said second antenna.

9. The information processing device of claim 8, wherein said processor processes said RFID data to authorize, customize, and/or otherwise affect the performance of the information processing device.

10. The information processing device of claim 1, wherein said antenna transmits said read pulse when said membrane assembly is activated.

11. The information processing device of claim 1, wherein said information processing device is one of a computing device, a consumer electronic device, a commercial electronic device, and a media output device.

12. The information processing device of claim 11, wherein said information processing device is a printing device.

13. An information processing system for providing controlled access to an information processing device, said information system comprising:

an RFID device associated with a user; and an information processing device having a secure state and an authorized state, said information processing device comprising:

a membrane assembly comprising:

a membrane layer having a surface adapted to be pressed by the user, said membrane layer defining a membrane perimeter; and a first antenna adapted to wirelessly communicate with said RFID device, wherein at least of portion of said antenna is disposed proximate said membrane layer within the membrane perimeter; and wherein a signal is transmitted between said first antenna and said RFID device for altering said information processing device from said secure state to said authorized state.

14. The information system of claim 13, wherein said antenna transmits a radio frequency read pulse to said RFID device.

15. The information system of claim 14, wherein said antenna is capable of receiving RFID data transmitted by said RFID device in response to said read pulse.

16. The information system of claim 15, further comprising a processor in communication with said antenna for processing said RFID data received by said first antenna.

17. The information system of claim 16, wherein said processor processes said RFID data to control said information processing device to provide said secure, on-demand media output.

18. The information system of claim 13, further comprising a second antenna, wherein said first antenna transmits a read pulse to said RFID device and said second antenna is capable of receiving RFID data transmitted by said RFID device in response to said read pulse.

19. The information system of claim 18, further comprising a processor in communication with said second antenna for processing said RFID data received by said second antenna.

20. The information system of claim 19, wherein said processor processes said RFID data to provide controlled access to said information processing device.

21. The information system of claim 13, wherein said first antenna transmits said read pulse when said membrane assembly is activated.

22. The information system of claim 13, wherein said membrane layer includes a switch assembly having a button area, and wherein said switch assembly is adapted to complete a bottom circuit for activating said antenna when said button area is pressed by the user.

23. The information system of claim 13, wherein said information processing device is a media output device.

24. The information system of claim 23, wherein said information processing device is a printing device.

* * * * *